US010237662B2

(12) United States Patent
Zhang et al.

(10) Patent No.: US 10,237,662 B2
(45) Date of Patent: Mar. 19, 2019

(54) SPEAKER MODULE WITH IMPROVED HEAT DISSIPATION

(71) Applicant: Goertek Inc., Shandong (CN)

(72) Inventors: Qingyi Zhang, Shandong (CN); Gang Chen, Shandong (CN); Shuangshuang Fan, Shandong (CN)

(73) Assignee: Goertek Inc., Shandong (CN)

( * ) Notice: Subject to any disclaimer, the term of this patent is extended or adjusted under 35 U.S.C. 154(b) by 0 days.

(21) Appl. No.: 15/762,588

(22) PCT Filed: Dec. 8, 2015

(86) PCT No.: PCT/CM2015/096721

§ 371 (c)(1),
(2) Date: Mar. 23, 2018

(87) PCT Pub. No.: WO2017/054318

PCT Pub. Date: Apr. 6, 2017

(65) Prior Publication Data

US 2018/0262841 A1 Sep. 13, 2018

(30) Foreign Application Priority Data

Sep. 30, 2015 (CN) ..... 2015 1 0642406

(51) Int. Cl.
*H04R 9/06* (2006.01)
*H04R 1/02* (2006.01)
*H04R 9/02* (2006.01)

(52) U.S. Cl.
CPC ..... *H04R 9/06* (2013.01); *H04R 1/025* (2013.01); *H04R 9/025* (2013.01)

(58) Field of Classification Search
CPC ..... H04R 1/025; H04R 9/025; H04R 9/06
See application file for complete search history.

(56) References Cited

U.S. PATENT DOCUMENTS

2002/0046900 A1 4/2002 Abe et al.
2014/0093095 A1 4/2014 Slotte et al.

FOREIGN PATENT DOCUMENTS

CN 200969679 Y 10/2007
CN 204231652 U 3/2015
(Continued)

OTHER PUBLICATIONS

English machine translation of CN204231652 (Zhang et al., Speaker Module, published Mar. 2015) (Year: 2015).*
(Continued)

*Primary Examiner* — Mark Fischer
(74) *Attorney, Agent, or Firm* — Alston & Bird LLP

(57) ABSTRACT

A speaker module comprising: a housing, the housing comprising an upper housing and a lower housing, the housing defining an inner cavity structure, at least one of the upper housing and the lower housing being provided with a group of micropores arranged in an array; and a speaker unit, comprising a magnetic circuit assembly and a vibrating assembly, the vibrating assembly dividing the inner cavity structure into a front cavity and a rear cavity, the magnetic circuit assembly being provided with a magnetic gap having a predetermined pattern, the magnetic circuit assembly being disposed close to the lower housing. A technical problem to be solved by the present invention is the heat dissipation of the speaker module.

9 Claims, 3 Drawing Sheets

(56) References Cited

FOREIGN PATENT DOCUMENTS

| | | | | |
|---|---|---|---|---|
| CN | 104737553 | A | | 6/2015 |
| CN | 204859555 | U | * | 12/2015 |
| JP | 2013-038682 | A | | 2/2013 |

OTHER PUBLICATIONS

International Searching Authority, International Search Report (ISR) and Written Opinion for International Application No. PCT/CN2015/096721, dated Mar. 24, 2016, 8 pages, State Intellectual Property Office of the P.R.C., China.

* cited by examiner

SPEAKER MODULE WITH IMPROVED HEAT DISSIPATION

CROSS-REFERENCE TO RELATED APPLICATIONS

This application is a National Stage of International Application No. PCT/CN2015/096721, filed on Dec. 8, 2015, which claims priority to Chinese Patent Application No. 201510642406.4, filed on Sep. 30, 2015, both of which are hereby incorporated by reference in their entireties.

BACKGROUND

Technical Field

The present invention relates to the field of an electroacoustic technology, and in particular, to a speaker.

Description of Related Art

With the continuous development of modern technology, people's requirements for electronic devices are getting higher and higher. People also put forward higher requirements on the quality of a speaker which serves as an integral part of the mobile device. The working power of the speaker also continuously increases while the sound quality and the volume of the speaker are improved. A vibrating diaphragm assembly in a speaker module will be hindered by air in front and back cavities at the time of vibrating, and thus a lot of heat will be generated during vibration. As the working power increases continuously, the heat generated in the working process will increase continuously. As a high-end electronic assembly, the speaker has a delicate configuration and a complicated structure, but is often unable to remove generated heat effectively in time. Excessive heat will have an impact on the vibrating diaphragm assembly and a magnetic circuit assembly.

In the prior art, in view of the relatively small size of the speaker module, the research and development personnel generally use inherent sound holes and damping holes of the speaker to dissipate the heat, rather than improve the configuration of the speaker to enhance the heat dissipation effect. However, the inventor has found that in the above-mentioned method, since the damping holes are generally away from a magnetic circuit and the sound holes are also away from a vibration assembly, heat cannot be dissipated effectively and quickly through the sound holes and the damping holes, and the heat dissipation efficiency is low. In addition, an opening rate of the damping holes and the sound holes is low, thereby affecting the heat dissipation effect. Therefore, the inventor provides a speaker module capable of effectively dissipating the heat of a speaker without affecting the acoustic characteristics of the speaker.

BRIEF SUMMARY

An objective of the present invention is to enhance a heat dissipation effect of a speaker module, without affecting the acoustic characteristics.

According to an aspect of the present invention, there is provided a speaker module, comprising: a housing, the housing comprising an upper housing and a lower housing, and the housing defining an inner cavity structure, at least one of the upper housing and the lower housing being provided with a group of micropores arranged in an array; and a speaker unit, comprising a magnetic circuit assembly and a vibrating assembly, the vibrating assembly dividing the inner cavity structure into a front cavity and a rear cavity, the magnetic circuit assembly being provided with a magnetic gap having a predetermined pattern, and the magnetic circuit assembly being disposed close to the lower housing.

Preferably, the group of micropores arranged in an array is arranged only on a position, corresponding to a region where the front cavity is located, of the upper housing.

Preferably, a group of micropores arranged in an array which corresponds to the pattern of the magnetic gap is arranged only on the lower housing.

Preferably, a magnetic conduction plate on which the group of micropores arranged in an array is disposed is arranged on a position, corresponding to the magnetic circuit assembly, of the lower housing.

Preferably, a group of micropores arranged in an array is respectively arranged on a position, corresponding to a region where the front cavity is located, of the upper housing and on a position, corresponding to the pattern of the magnetic gap, of the lower housing.

Preferably, a magnetic conduction plate on which the group of micropores arranged in an array is disposed is arranged on a position, corresponding to the magnetic circuit assembly, of the lower housing.

Preferably, the diameter of the micropore is not greater than 0.05 mm.

Preferably, the speaker unit corresponding to the housing is provided with injection molded steel sheets, and the group of micropores arranged in an array is arranged on the corresponding injection molded steel sheet.

Preferably, the housing further comprises an intermediate housing, and the upper housing, the intermediate housing and the lower housing define an inner cavity structure together.

The present invention has a technical effect that the heat dissipation effect of the speaker module is enhanced by the group of micropores arranged in an array arranged at least on the upper housing or the lower housing. Compared with the sound holes and the damping holes in the prior art, the group of micropores arranged in an array arranged on the upper housing or the lower housing of the present invention is closer to a heat source and has a higher opening ratio, thereby greatly improving the heat dissipation efficiency of the speaker module.

The inventor of the present invention has found that in the prior art, in view of the exquisite configuration of the speaker module, the research and development personnel generally use inherent sound holes and damping holes to dissipate the heat, rather than improve the configuration of the speaker module to dissipate heat. However, since the sound holes and the damping holes are away from a heat source, there is a defect of low heat dissipation efficiency. Therefore, the technical task to be implemented or the technical problem to be solved by the present invention is not anticipated by those skilled in the art, and thus the present invention is a novel technical solution.

Other features and advantages of the present invention will become apparent through the detailed descriptions of the exemplary embodiments of the present invention with reference to the drawings.

BRIEF DESCRIPTION OF THE FIGURES

The drawings that constitute a part of the description show the embodiments of the present invention and are intended to explain the principle of the present invention together with the descriptions thereof.

BRIEF DESCRIPTION OF THE VARIOUS EMBODIMENTS

Figure 1:
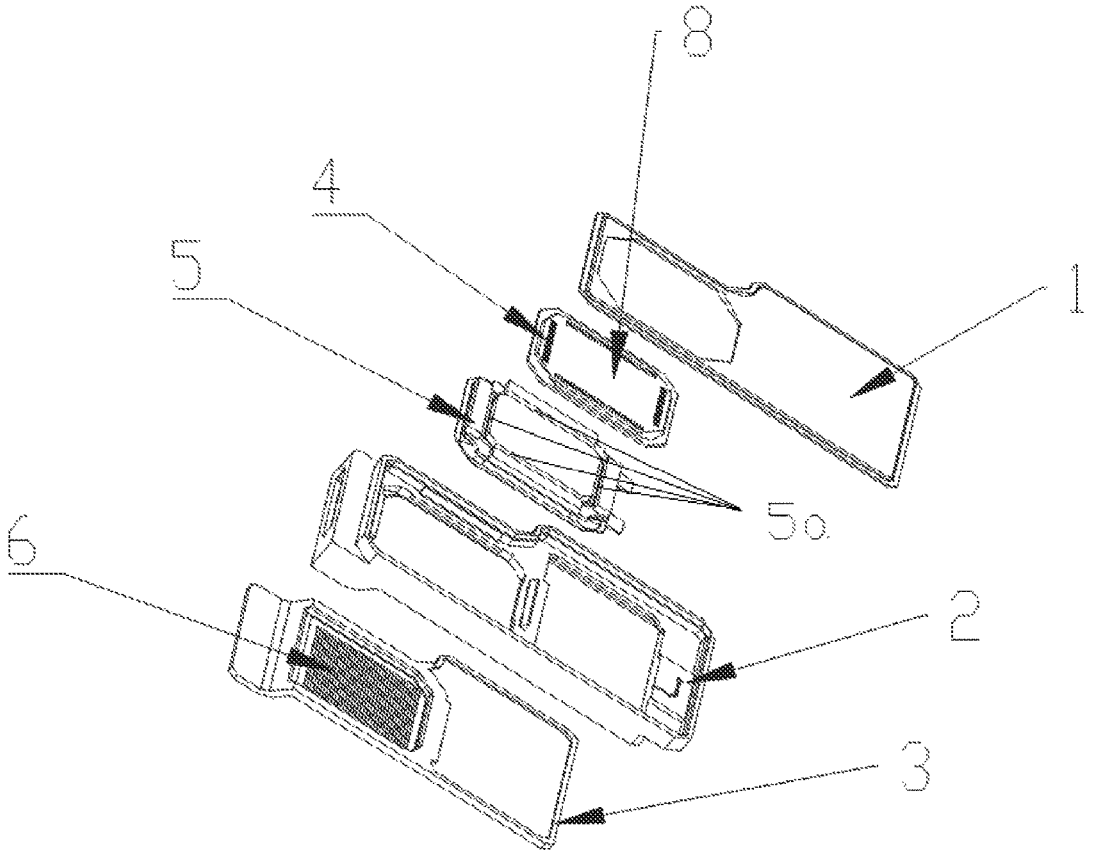
FIG. 1 is a schematic drawing of a speaker module.

Now, various exemplary embodiments of the present invention will be described in detail with reference to the drawings. It should be noted that, unless specified otherwise, the relative arrangements of the members and steps, the mathematical formulas and numerical values described in these embodiments do not restrict the scope of the present invention.

The following descriptions for at least one embodiment are actually descriptive only, and shall not be intended to limit the invention and any application or use thereof.

The techniques and devices well known to those skilled in the related arts may not be discussed in detail. However, where applicable, such techniques and devices should be deemed as a part of the description.

Any specific value shown herein and in all the examples should be interpreted as exemplary only rather than restrictive. Therefore, other examples of the exemplary embodiments may include different values.

It should be noted that similar signs and letters in the following drawings represent similar items. Therefore, once defined in one drawing, an item may not be further discussed in the followed drawings.

According to a first specific embodiment of the present invention, there is provided a speaker module. The speaker comprises a housing and a speaker unit. The housing is divided into an upper housing 3, an intermediate housing 2 and a lower housing 1, the upper housing 3, the intermediate housing 2 and the lower housing 1 defining an inner cavity structure. The speaker unit comprises a magnetic circuit assembly 5 and a vibrating assembly, the vibrating assembly dividing the inner cavity structure into a front cavity and a rear cavity. A voice coil 7 is arranged in the vibrating assembly. The magnetic circuit assembly 5 is provided with a magnetic gap 5*a* having a predetermined pattern, and is close to the lower housing 1.

In the present embodiment, a group of micropores arranged in an array 6 is arranged only on a position, corresponding to a region where the front cavity is located, of the upper housing 3. The group of micropores arranged in an array herein refers to a group of micropores arranged in an array which is provided by laser. In practice, the group of micropores arranged in an array may also be formed by etching or the like. In the present embodiment, the diameter of the micropore is controlled to be within 0.05 mm, so as to prevent sound emission from the micropores. In the present embodiment, a position, corresponding to the group of micropores arranged in an array 6, on the upper housing 3 is made of an injection-molded steel sheet. However, it should be understood by those skilled in the art that this is only the most preferred mode of the present embodiment and a material of the upper housing 3 should not be specifically limited. Those skilled in the art can make variations and expansions in accordance with the actual situations, but these variations and expansions should all fall within the protection scope of the present invention.

In the present embodiment, the group of micropores arranged in an array 6 is arranged only on the position, corresponding to the region where the front cavity is located, of the upper housing 3, and a vibrating diaphragm in the vibrating assembly divides the inner cavity structure into the front cavity and the rear cavity. Therefore, it can also be said that the group of micropores arranged in an array 6 arranged in the present embodiment corresponds to the vibrating diaphragm. When the speaker module operates, the vibrating diaphragm will produce a lot of heat at the time of vibrating. This method of dissipating heat by providing micropores on the position, corresponding to the region where the front cavity is located, of the upper housing directly utilizes conduction to dissipate the heat instead of dissipating heat indirectly through inherent sound holes in the prior art. In this method, the diameter of the micropore directly corresponds to a heat source, such that heat at the vibrating diaphragm can be discharged to the outside of the speaker module effectively in time to prevent the deformation of the vibrating diaphragm due to high temperature. The inventor has considered the acoustic characteristics of the speaker module and therefore put forward a requirement on the diameter of the micropore. Based on repeated experiments, the inventor has found that the diameter of the micropore should be controlled to be within 0.05 mm so as to prevent sound emission from the micropores. That is to say, the speaker module has an outstanding heat dissipation effect while the acoustic characteristics thereof are ensured.

According to a second specific embodiment of the present invention, there is provided a speaker module. The speaker comprises a housing and a speaker unit. The housing is divided into an upper housing 3, an intermediate housing 2 and a lower housing 1, the upper housing 3, the intermediate housing 2 and the lower housing 1 defining an inner cavity structure. The speaker unit comprises a magnetic circuit assembly 5 and a vibrating assembly, the vibrating assembly dividing the inner cavity structure into a front cavity and a rear cavity. A voice coil 7 is arranged in the vibrating assembly. The magnetic circuit assembly 5 is provided with a magnetic gap 5*a* having a predetermined pattern, and is close to the lower housing.

In the present embodiment, a group of micropores arranged in an array which corresponds to the pattern of the magnetic gap is arranged only on the lower housing 1. The group of micropores arranged in an array herein refers to a group of micropores arranged in an array which is provided by laser. In practice, the group of micropores arranged in an array may also be formed by etching or the like. In the present specific embodiment, the diameter of the micropore is controlled to be within 0.05 mm, so as to prevent sound emission from the micropores.

In the present embodiment, the group of micropores arranged in an array 4 which corresponds to the pattern of the magnetic gap is arranged only on the lower housing 1, and the arranged group of micropores arranged in an array corresponds to the magnetic gap. Therefore, this method directly utilizes conduction of the group of micropores arranged in an array to dissipate the heat instead of dissipating heat indirectly through inherent damping holes in the prior art. In this method, the diameter of the micropore directly corresponds to a heat source, such that heat at the magnetic gap can be discharged to the outside of the speaker module effectively in time to prevent demagnetization due to high temperature. The inventor has considered the acoustic characteristics of the speaker module and therefore put forward a requirement on the diameter of the micropore. Based on repeated experiments, the inventor has found that the diameter of the micropore should be controlled to be within 0.05 mm so as to prevent sound emission from the micropores. That is to say, the speaker module has an outstanding heat dissipation effect while the acoustic characteristics thereof are ensured.

According to a third specific embodiment of the present invention, there is provided a speaker module. The speaker comprises a housing and a speaker unit. The housing is divided into an upper housing 3, an intermediate housing 2 and a lower housing 1, the upper housing 3, the intermediate housing 2 and the lower housing 1 defining an inner cavity structure. The speaker unit comprises a magnetic circuit assembly 5 and a vibrating assembly, the vibrating assembly dividing the inner cavity structure into a front cavity and a rear cavity. A voice coil 7 is arranged in the vibrating assembly. The magnetic circuit assembly 5 is provided with a magnetic gap 5*a* having a predetermined pattern, and is close to the lower housing.

In the present embodiment, a magnetic conduction plate 8 is arranged on a position, corresponding to the magnetic circuit assembly 5, of the lower housing 1. In the present embodiment, a group of micropores arranged in an array 4 which corresponds to the magnetic gap is arranged only on a magnetic conduction plate 8. The group of micropores arranged in an array herein refers to a group of micropores arranged in an array which is provided by laser. In practice, the group of micropores arranged in an array may also be formed on the magnetic conduction plate by etching or the like. In the present embodiment, the diameter of the micropore is controlled to be within 0.05 mm, so as to prevent sound emission from the micropores.

In the present embodiment, the group of micropores arranged in an array 4 which corresponds to the magnetic gap is arranged only on the magnetic conduction plate 8, and the arranged group of micropores arranged in an array 4 corresponds to the magnetic gap. Therefore, this method directly utilizes conduction of the group of micropores arranged in an array to dissipate the heat instead of dissipating heat indirectly through inherent damping holes in the prior art. In this method, the diameter of the micropore directly corresponds to a heat source, such that heat at the magnetic gap can be discharged to the outside of the speaker module effectively in time to prevent demagnetization due to high temperature and the deformation of the vibrating diaphragm due to too high temperature. The inventor has considered the acoustic characteristics of the speaker module and therefore put forward a requirement on the diameter of the micropore. Based on repeated experiments, the inventor has found that the diameter of the micropore should be controlled to be within 0.05 mm so as to prevent sound emission from the micropores. That is to say, the speaker module has an outstanding heat dissipation effect while the acoustic characteristics thereof are ensured.

According to a fourth specific embodiment of the present invention, there is provided a speaker module. The speaker comprises a housing and a speaker unit. The housing is divided into an upper housing 3, an intermediate housing 2 and a lower housing 1, the upper housing 3, the intermediate housing 2 and the lower housing 1 defining an inner cavity structure. The speaker unit comprises a magnetic circuit assembly 5 and a vibrating assembly, the vibrating assembly dividing the inner cavity structure into a front cavity and a rear cavity. A voice coil 7 is arranged in the vibrating assembly. The magnetic circuit assembly 5 is provided with a magnetic gap 5*a* having a predetermined pattern, and is close to the lower housing.

In the present embodiment, a group of micropores arranged in an array is respectively arranged on a position, corresponding to a region where the front cavity is located, of the upper housing 3 and on a position, corresponding to the magnetic gap, of the lower housing 1. The group of micropores arranged in an array herein refers to a group of micropores arranged in an array which is provided by laser. In practice, the group of micropores arranged in an array may also be formed by etching or the like. In the present embodiment, the diameter of the micropore is controlled to be within 0.05 mm, so as to prevent sound emission from the micropores. In the present embodiment, the position, corresponding to the group of micropores arranged in an array 6, on the upper housing 3 is made of injection-molded steel sheets. However, it should be understood by those skilled in the art that this is only the most preferred mode of the present embodiment and a material of the upper housing 3 should not be specifically limited. Those skilled in the art can make variations and expansions in accordance with the actual situations, but these variations and expansions should all fall within the protection scope of the present invention.

In the present embodiment, the group of micropores arranged in an array is respectively arranged on the position, corresponding to the region where the front cavity is located, of the upper housing and on the position, corresponding to the magnetic gap, in the magnetic circuit assembly; the group of micropores arranged in an array arranged on the upper housing corresponds to a vibrating diaphragm and the group of micropores arranged in an array arranged on the lower housing corresponds to the magnetic gap. Therefore, this method directly utilizes groups of micropores arranged in arrays on two positions to dissipate the heat. In this method, the diameter of the micropore directly corresponds to heat sources at the vibrating diaphragm and the magnetic gap, such that heat at the vibrating diaphragm and the magnetic gap can be discharged to the outside of the speaker module effectively in time to prevent demagnetization due to high temperature and the deformation of the vibrating diaphragm due to too high temperature. In addition, the arrangement method can effectively improve the air pressure environment in the cavities at the time of vibrating, reduce the resistance of the vibrating diaphragm during vibration and effectively reduce the heat generated by the voice coil. The inventor has considered the acoustic characteristics of the speaker module while considering the maximum heat dissipation and therefore put forward a requirement on the diameter of the micropore. Based on repeated experiments, the inventor has found that the diameter of the micropore should be controlled to be within 0.05 mm so as to prevent sound emission from the micropores. That is to say, the speaker module has an optimal heat dissipation effect while the acoustic characteristics thereof are ensured.

According to a fifth specific embodiment of the present invention, there is provided a speaker module. The speaker comprises a housing and a speaker unit, and the specific structure is as shown in FIG. 1. The housing is divided into an upper housing 3, an intermediate housing 2 and a lower housing 1, the upper housing 3, the intermediate housing 2 and the lower housing 1 defining an inner cavity structure. In the present embodiment, the lower housing further comprises a magnetic conduction plate corresponding to a magnetic circuit assembly 5. The speaker unit comprises the magnetic circuit assembly 5 and a vibrating assembly, the vibrating assembly dividing the inner cavity structure into a front cavity and a rear cavity. A voice coil 7 is arranged in the vibrating assembly. The magnetic circuit assembly 5 is provided with a magnetic gap 5*a* having a predetermined pattern, and is close to the lower housing.

Figure 2:
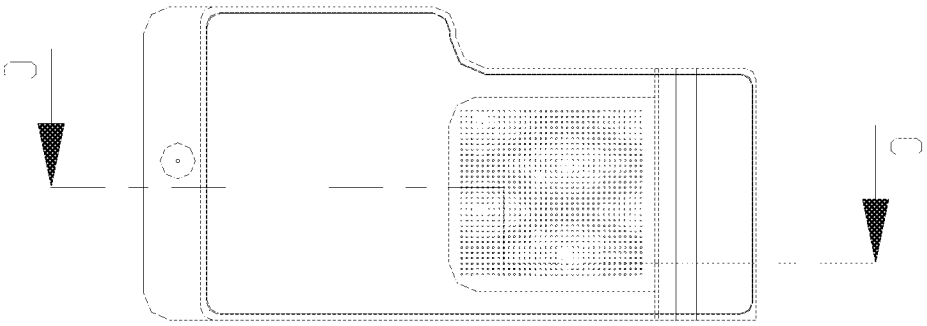
FIG. 2 is a schematic drawing of the speaker module.
Figure 3:
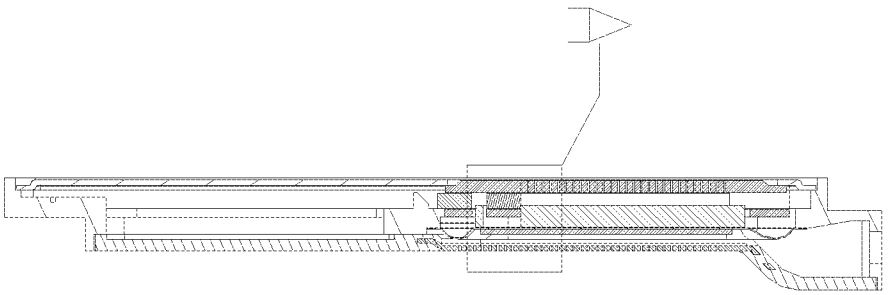
FIG. 3 is a sectional view of parts c and c' in FIG. 2.
Figure 4:
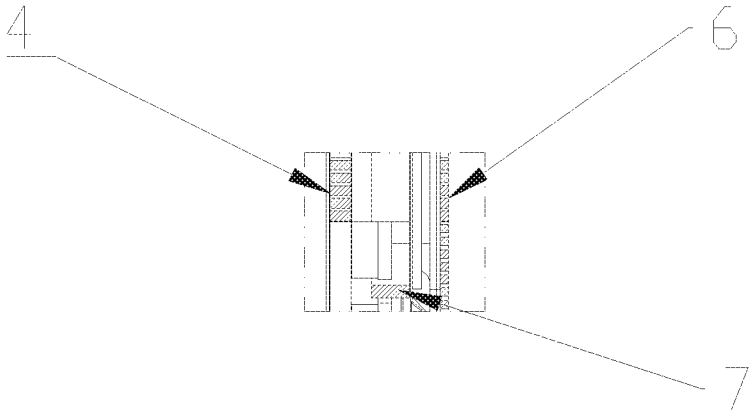
FIG. 4 is an enlarged drawing of part A in FIG. 3.

In the present embodiment, a group of micropores arranged in an array 6 is arranged on a position, corresponding to the region where the front cavity is located, of the upper housing 3 and a group of micropores arranged in an array 4 is arranged on a position, corresponding to the magnetic gap, on the magnetic conduction plate 8 of the lower housing 1, and the specific arrangement is as shown in FIGS. 2 to 4. The group of micropores arranged in an array herein refers to a group of micropores arranged in an array which is provided by laser. In practice, the micropores may also be formed by etching or the like. In the present embodiment, the diameter of the micropores is controlled within to be 0.05 mm, so as to prevent sound emission from the micropores. In the present embodiment, the position, corresponding to the group of micropores arranged in an array 6, on the upper housing 3 is made of injection-molded steel sheets. However, it should be understood by those skilled in the art that this is only the most preferred mode of the present embodiment and a material of the housing should not be specifically limited. Those skilled in the art can make variations and expansions in accordance with the actual situations, but these variations and expansions should all fall within the protection scope of the present invention.

In the present embodiment, the group of micropores arranged in an array 6 is arranged on the position, corresponding to the region where the front cavity is located, of the upper housing 3, and the group of micropores arranged in an array 4 is arranged on the position, corresponding to the magnetic gap, of the magnetic conduction plate 8 of the lower housing. The position, where the group of micropores arranged in an array is arranged, of the upper housing corresponds to the vibrating diaphragm, and the position, where the group of micropores arranged in an array is arranged, on the magnetic conduction plate 8 of the lower housing corresponds to the magnetic gap. Therefore, this method directly utilizes groups of micropores arranged in arrays at two positions to dissipate the heat. In this method, the diameter of the micropore directly corresponds to heat sources at the vibrating diaphragm and the magnetic gap, such that heat at the vibrating diaphragm and the magnetic gap can be discharged to the outside of the speaker module effectively in time to prevent demagnetization due to high temperature and the deformation of the vibrating diaphragm due to too high temperature. In addition, the arrangement method can effectively improve the air pressure environment in the cavities at the time of vibrating, reduce the resistance of the vibrating diaphragm during vibration and effectively reduce the heat generated by the voice coil. Therefore, the present embodiment is the optimal embodiment, i.e., the heat dissipation efficiency in this embodiment is the maximum. The inventor has considered the acoustic characteristics of the speaker module while considering the maximum heat dissipation and therefore put forward a requirement on the diameter of the micropore. Based on repeated experiments, the inventor has found that the diameter of the micropore should be controlled to be within 0.05 mm so as to prevent sound emission from the micropores. That is to say, the speaker module has an optimal heat dissipation effect while the acoustic characteristics thereof are ensured.

Although specific embodiments of the present invention are described in detail through some examples, those skilled in the art shall understand that the above examples are illustrative only and are not intended to limit the scope of the present invention, that modifications can be made to the above embodiments without departing from the scope and spirit of the present invention, and that the scope of the present invention is defined by the appended claims.

What is claimed is:

1. A speaker module, comprising:

a housing comprising an upper housing and a lower housing, the housing defining an inner cavity structure and at least one of the upper housing and the lower housing being provided with a group of micropores arranged in an array; and a speaker unit comprising a magnetic circuit assembly and a vibrating assembly, the vibrating assembly dividing the inner cavity structure into a front cavity and a rear cavity, the magnetic circuit assembly being provided with a magnetic gap having a predetermined pattern, and the magnetic circuit assembly being disposed close to the lower housing.

2. The speaker module according to claim 1, wherein the group of micropores arranged in an array is arranged only on a position of the upper housing, which corresponds to a region where the front cavity is located.

3. The speaker module according to claim 1, wherein the group of micropores arranged in an array which corresponds to the pattern of the magnetic gap is arranged only on the lower housing.

4. The speaker module according to claim 3, wherein a magnetic conduction plate on which the group of micropores arranged in an array is disposed is arranged on a position of the lower housing (1), which corresponds to the magnetic circuit assembly.

5. The speaker module according to claim 1, wherein the group of micropores arranged in an array is respectively arranged on a position, corresponding to a region where the front cavity is located, of the upper housing and a position, corresponding to the pattern of the magnetic gap, of the lower housing.

6. The speaker module according to claim 5, wherein a magnetic conduction plate on which the group of micropores arranged in an array is disposed is arranged on a position, corresponding to the magnetic circuit assembly, of the lower housing.

7. The speaker module according to claim 1, wherein the diameter of the micropore is not greater than 0.05 mm.

8. The speaker module according to claim 1, wherein the speaker unit corresponding to the housing is provided with an injection molded steel sheet, and the group of micropores arranged in an array is arranged on the corresponding injected molded steel sheet.

9. The speaker module according to claim 1, wherein the housing further comprises an intermediate housing, and the upper housing, the intermediate housing and the lower housing define an inner cavity structure together.

* * * * *